US007918751B1

(12) United States Patent
Mayes

(10) Patent No.: US 7,918,751 B1
(45) Date of Patent: Apr. 5, 2011

(54) METHOD OF RATING GOLF BALLS

(75) Inventor: Gary N. Mayes, Madison, AL (US)

(73) Assignee: Equip2Golf, Inc., Madison, AL (US)

( * ) Notice: Subject to any disclaimer, the term of this patent is extended or adjusted under 35 U.S.C. 154(b) by 0 days.

(21) Appl. No.: 11/243,061

(22) Filed: Oct. 4, 2005

Related U.S. Application Data

(60) Provisional application No. 60/616,395, filed on Oct. 5, 2004.

(51) Int. Cl.
*A63B 69/36* (2006.01)

(52) U.S. Cl. ..... 473/409

(58) Field of Classification Search ..... None
See application file for complete search history.

(56) References Cited

U.S. PATENT DOCUMENTS 5,803,833 A * 9/1998 Nakamura et al. ..... 473/377

* cited by examiner

*Primary Examiner* — Raeann Trimiew
(74) *Attorney, Agent, or Firm* — George P. Kobler; Lanier Ford Shaver & Payne, P.C.

(57) ABSTRACT

A golf ball analysis and rating method is provided to test and report golf ball characteristics of distance, spin, balance, feel, durability and price compared to other golf ball models wherein a set of golf balls of like model from the same manufacturer are shot-tested using a plurality of golf shots with a driver, an iron, and a wedge to obtain distance and spin data, balance tested to obtain data to rate balance, compression and cover hardness tested to obtain data to rate feel, durability tested to obtain date to rate durability, and price data is obtained to rate price. The data are analyzed and ratings corresponding to average values for each of the characteristics are assigned.

4 Claims, 2 Drawing Sheets

| Brand/Model | Distance (Di) | Driver Distance | Iron Distance | Wedge Distance | Spin | Driver Spin | Iron Spin | Full Wedge Spin | Partial Wedge Spin | Feel Compression | Feel Cover Hardness | Durability | Balance | Price |
|---|---|---|---|---|---|---|---|---|---|---|---|---|---|---|
| Golf Ball A | $D_{RA}$ | $DD_{RA}$ | $DI_{RA}$ | $DW_{RA}$ | $S_{RA}$ | $SD_{RA}$ | $SI_{RA}$ | $SWF_{RA}$ | $SWP_{RA}$ | $FC_{RA}$ | $FH_{RA}$ | $DU_{RA}$ | $B_{RA}$ | $P_{RA}$ |
| Golf Ball B | $D_{RB}$ | $DD_{RB}$ | $DI_{RB}$ | $DW_{RB}$ | $S_{RB}$ | $SD_{RB}$ | $SI_{RB}$ | $SWF_{RB}$ | $SWP_{RB}$ | $FC_{RB}$ | $FH_{RB}$ | $DU_{RB}$ | $B_{RB}$ | $P_{RB}$ |
| Golf Ball C | $D_{RC}$ | $DD_{RC}$ | $DI_{RC}$ | $DW_{RC}$ | $S_{RC}$ | $SD_{RC}$ | $SI_{RC}$ | $SWF_{RC}$ | $SWP_{RC}$ | $FC_{RC}$ | $FH_{RC}$ | $DU_{RC}$ | $B_{RC}$ | $P_{RC}$ |
| . . . | . . . | . . . | . . . | . . . | . . . | . . . | . . . | . . . | . . . | . . . | . . . | . . . | . . . | . . . |
| Golf Ball n | $D_{Rn}$ | $DD_{Rn}$ | $DI_{Rn}$ | $DW_{Rn}$ | $S_{Rn}$ | $SD_{Rn}$ | $SI_{Rn}$ | $SWF_{Rn}$ | $SWP_{Rn}$ | $FC_{Rn}$ | $FH_{Rn}$ | $DU_{Rn}$ | $B_{Rn}$ | $P_{Rn}$ |

301 304 302 304 304 304 302 302 306 300

*Fig. 3*

METHOD OF RATING GOLF BALLS

CROSS-REFERENCE TO RELATED APPLICATIONS

This application claims the benefit of U.S. Provisional Application No. 60/616,395, filed Oct. 5, 2004, which is incorporated by reference in its entirety.

BACKGROUND

1. Field

The present invention relates generally to a method of rating golf ball models, and particularly, to a method of rating golf ball models according to performance categories of distance, spin, feel, durability, balance, and price. More particularly, the present invention relates to a method of rating golf ball models with respect to other golf ball models.

2. Description of the Problem

Golf balls are often marketed to consumers based upon performance parameters, namely, distance, spin and feel that a particular golf ball in question would allegedly exhibit. However, current and existing methods are tied to the manufacturers of the golf balls. Currently, there exists no method that provides comparative analysis of all golf balls, regardless of manufacturer. The information provided by this invention will serve consumers in assisting them in their selection of the appropriate golf ball for their needs. Additionally, this invention will also serve the golf industry by providing a reference standard by which golf ball performance can be measured. Typically, golf ball manufacturers provide information to assist consumers in selecting a golf ball within their product line. Confusion within consumers is created when they attempt to compare golf balls between manufacturers. This is a result of aggressive marketing claims by each manufacturer that their golf ball outperforms their competition. While manufacturers provide performance information about their own product line, they seldom provide relative performance information about their competitors in an independent fashion.

The need for the invention came about as a result of the lack of information readily accessible to consumers regarding golf ball performance data. The United States Golf Association (USGA) routinely tests all golf balls for conformance to the Rules of Golf. This data is confidential and is not shared with manufacturers or the consumer public. It is used to produce the USGA's List of Conforming Golf Balls. Other testing companies have proprietary methods for assessing golf ball performance. The subject invention offers not only a test method but a process for assigning a relative performance ranking to each golf ball for comparison purposes. This invention provides an independent systematic method for presenting this information in a manner for which relative comparisons can be made between golf balls regardless of manufacturer.

SUMMARY OF THE INVENTION

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

The objective of the invention is to provide performance information on golf balls in a manner that will assist in selecting a golf ball that meets specific selection criteria (i.e., equipment, swing and price). The key feature of the invention is a set of performance indexes that identify golf ball spin and distance information across equipment (i.e., driver, iron, and wedge), swing (speed, types), durability, feel, balance and price (i.e., low, middle, high) parameters.

These and other embodiments of the present invention will also become readily apparent to those skilled in the art from the following detailed description of the embodiments having reference to the attached figures, the invention not being limited to any particular embodiment(s) disclosed.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

FIG. 3 is an exemplary presentation format according to an embodiment of the present invention.

DETAILED DESCRIPTION

Figure 1:
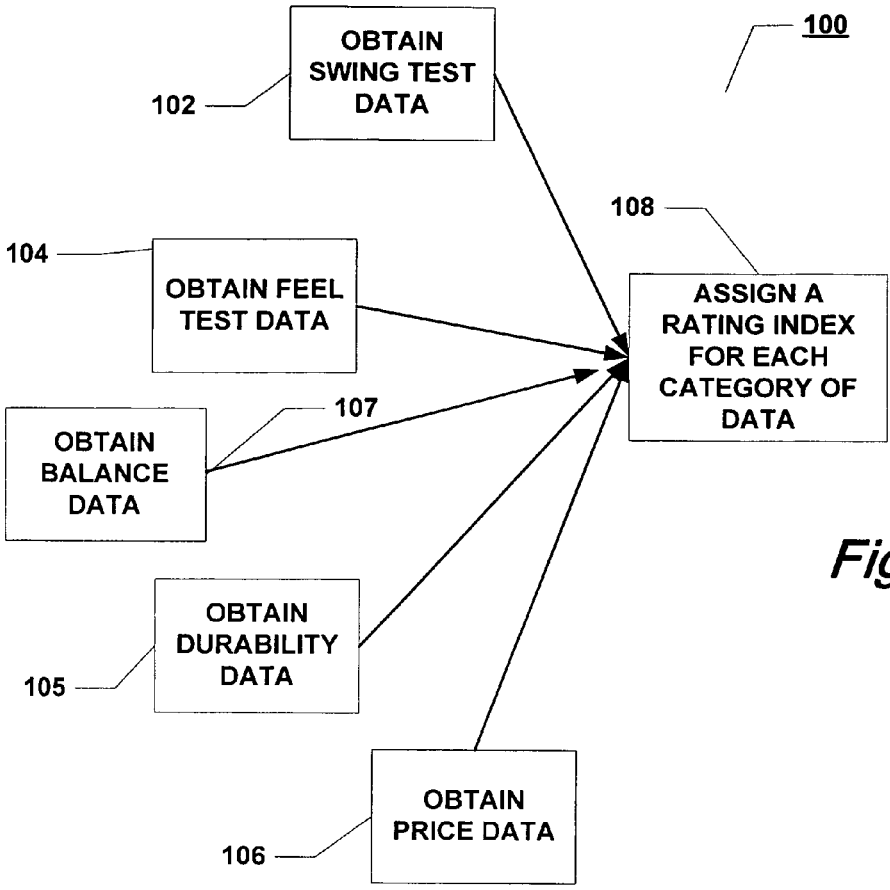
FIG. 1 is a flow chart of the process for rating golf balls according to an embodiment of the present invention.
Figure 2:
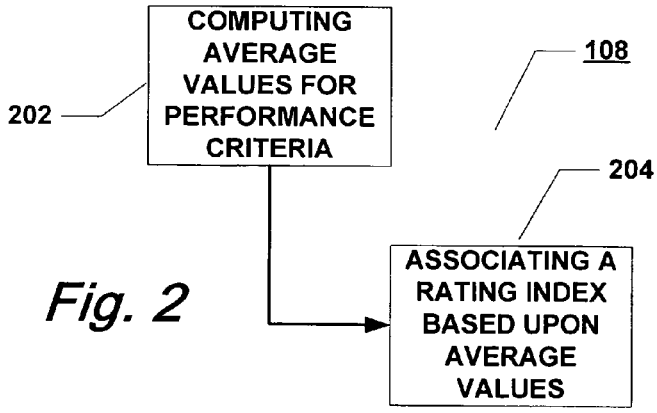
FIG. 2 is a flow chart of the process for the step of assigning a rating value to a golf ball according to an embodiment of the present invention.

The various embodiments of the present invention and their advantages are best understood by referring to FIGS. 1 through 3 of the drawings. The elements of the drawings are not necessarily to scale, emphasis instead being placed upon clearly illustrating the principles of the invention. Throughout the drawings, like numerals are used for like and corresponding parts of the various drawings.

This invention may be provided in other specific forms and embodiments without departing from the essential characteristics as described herein. The embodiments described above are to be considered in all aspects as illustrative only and not restrictive in any manner. The following claims rather than the foregoing description indicate the scope of the invention.

The invention comprises a method that is accomplished by performing three functions: golf ball testing, data analysis, and rating calculation & index compilation. With reference to FIG. 1, the inventive method 100 is performed by obtaining swing test data 102, obtaining feel test data 104, obtaining durability data 105, obtaining price data 106, and obtaining balance data 107. These steps may be performed for each brand and model of golf ball, in any order or simultaneously. The data are then used to compute a rating index for each brand of golf balls, for each data category 108. It should be noted that the list of performance parameters provided herein is not exhaustive. The inventive method may be performed any parameters relevant to the performance of a golf ball, even those that may be hereafter developed.

The step of obtaining swing test data 102 consists of performing scientific-based swing testing using systematic test procedures and may employ a computer-based camera data acquisition system. The test environment consists of an indoor or outdoor environment utilizing a mechanical golf swing machine, a launch monitor system, and swing speed analyzer. A non-limiting example of a suitable swing machine is the well-known "Iron Byron" developed by True Temper Sports, Inc. Launch monitor systems and swing speed analyzers are commercially available, and also known in the art. A human golfer may also be used to perform swings.

Data analysis is performed by compiling data from the launch monitor system measuring golf ball backspin, sidespin, velocity, launch angle and side angle. The launch monitor system takes the measured data and then calculates shot carry distance, shot dispersion, and shot trajectory. Preferably, any or all of four swing tests are conducted on each golf ball: driver test, iron test, full wedge test, and partial wedge test. Floor templates should be used to place the equipment in the same location every time ensuring consistency within each test. Golf shots are hit from golf practice mats. To insure accurate comparison data, swing tests are preferably performed for each different type of golf ball under the same environmental conditions, including, for example, the utilization of the same golf practice mat, or same brand of golf practice mat, from which the balls are launched.

In swing tests conducted with the mechanical swing machine, a set of different swing speeds (for example, 85, 95, 105, 115 MPH) can be used for each golf ball. For each test a new sleeve of three golf balls is used and only on-center shots, ball strikes occurring in the center of the club face, are tabulated and recorded. This is determined by using the launch monitor system and impact dispersion on the club face. Off-center shots are re-tried until an on-center shot occurs. Therefore, in some cases it may take 2 or more shots to get 1 data point that is included in the set. This procedure is repeated until 10 solid shots, or a statistically significant number of shots, are recorded for each golf ball within each swing test, at each swing speed.

Preferably, the swing speed analyzer comprises a highly precise laser and sensing components enabling tight tolerances on swing speed measurements. If the swing tests are performed using a human tester, the tester should possess a target USGA index between 0 and 1, and consistently swing the clubs with an average driver swing speed of about 100 MPH, iron swing speed of about 80 MPH (6-iron), and wedge swing speed of about 75 MPH. It will be appreciated that other speeds may be tested using the human golfer as long as the speeds are consistent and reasonable for the club with which the shots are made.

A control golf ball is preferably used for each test that is conducted to determine if similar atmospheric conditions are present for each test. Necessary adjustments are made to the data based on the differences found in the control golf ball from test to test. Preferably, tests are performed for each different type of golf ball under the same conditions.

The driver swing test may be performed using a titanium driver with standard specifications of 9.5 degrees loft, 45 inches length, 57 degrees lie, and regular flex shaft. For the human-based test, a target swing speed of between about 98 to about 102 MPH may be used to ensure consistency and accuracy from shot to shot. No matter what range of swing velocities is deemed to be the target range, shots hit with speeds outside of the target range are deleted and re-tried. For the machine run swing test, an exemplary target swing speeds of about 85, 95, 105, and 115 MPH may be used to cover a spectrum of swing speeds. The data collected represent the initial spin rate off a driver in revolutions per minute (RPM) and carry distance in yards.

The iron swing test may be performed using any iron. However, it is preferable to use a club that corresponds generally to a standard six iron, for example, an iron having about 30 degrees loft, about 37.5 inches length, and about 61 degrees lie. It will be recognized that club specifications differ from manufacturer to manufacturer. It is important to use a club with the same specifications for each series of tests. The iron should also have the same flex, and head material. To increase the likelihood that the data will be more meaningful to the average golfer, it is preferable to use a steel shaft and a cast steel head. For the human-based test, an exemplary target swing speed of between about 78 to about 82 MPH may be used to ensure consistency and accuracy from shot to shot. Shots hit with speeds outside the target range are deleted and re-tried. For the machine-based swing test, exemplary target swing speeds of about 68, 76, 84, and 92 MPH may be used to cover a spectrum of swing speeds. The data collected represents the initial spin rate off an iron in revolutions per minute (RPM) and carry distance in yards.

The wedge test preferably comprises two sub-tests. These are the full wedge test and the partial wedge test. Both the full and partial wedge tests should be performed using a standard wedge club, again with a cast steel head and regular flex steel shaft. It will be appreciated that wedges very greatly depending upon the type of wedge. As with the previous swing tests, it is important to keep the wedge the same from sample to sample. In one embodiment, the wedge test is performed with a wedge with specifications of about 46 degrees loft, about 36 inches length, and about 64 degrees lie.

For the full wedge test, if test shots are made by a human, an exemplary target swing speed of between about 73 to about 77 MPH may be used to ensure consistency and accuracy from shot to shot. Shots hit with speeds outside the target range are deleted and re-tried. For the machine run swing test, exemplary target swing speeds of about 64, 71, 79, and 86 MPH may be used to cover a spectrum of swing speeds.

For the partial wedge test, if swing test shots are made by a human, an exemplary target swing speed of between about 51 to about 55 MPH may be used to ensure consistency and accuracy from shot to shot. Shots hit with speeds outside of the target range are deleted and re-tried. For the machine run swing test, exemplary target swing speeds of 48, 53, 59, and 65 MPH may be used to cover a spectrum of swing speeds. The data collected from both tests represent the initial spin rate off a wedge in revolutions per minute (RPM) and carry distance in yards.

Feel data 104 is obtained from a feel test performed on each golf ball addressing golf ball cover hardness and compression. A durometer, preferably in accordance with the ASTM D 2240 standard, is used to test golf ball cover hardness which is recorded for each golf ball. A golf ball compression tester may be used to test golf ball compression and the compression measurement obtained by the tester is recorded for each golf ball. The test may be conducted by applying about 400 lbs of force by the test machine. One dozen golf balls, or a statistically significant number, of each brand are subjected to each of these tests.

Obtaining durability data 105 comprises assessing the golf balls used in the previously identified tests with respect to the number of surface abrasions and severity of the abrasion that each ball displays. During each test, each golf ball was subjected to the approximately 12 shots, or a statistically significant number of shots, from a driver, iron, and wedge. Golf balls are inspected and assigned a rating that indicates the number of abrasions and a subjective assessment of the severity of abrasions. The following Table 1 displays an exemplary durability scoring system that may be used in for the durability test.

TABLE 1

Exemplary Durability Scoring Codes and Assessment Guidelines.

| Score | No. of Abrasions | Severity of Abrasions |
|---|---|---|
| 10 | 1 | Minor 1 (slight shaving of the golf ball in one area; retains original finish) |
| 9 | 2 | Minor 2 (slight shaving of the golf ball in two areas; retains original finish) |
| 8 | ≧3 | Minor 3 (slight shaving of the golf ball in multiple areas; retains original finish) |
| 7 | 1 | Minor 4 (shaving of the golf ball in one area; retains original finish) |
| 6 | ≧3 | Minor 5 (shaving of the golf ball in multiple areas; retains original finish) |
| 5 | 1 | Major 1 (shaving and abrasions of the golf ball in one area; may retain original finish or original finish may appear discolored or faded; surface may have deep marks) |
| 4 | ≧3 | Major 2 (shaving and abrasions of the golf ball in multiple areas; may retain original finish or original finish may appear discolored or faded; shallow marks) |
| 3 | 1 | Major 3 (shaving and abrasions of the golf ball in one area; may retain original finish or original finish may appear discolored or faded; shallow marks) |
| 2 | 2 | Major 4 (more significant shaving and abrasions of the golf ball in two areas; may retain original finish or original finish may appear discolored or faded; deep marks) |
| 1 | ≧3 | Major 5 (more significant shaving and abrasions of the golf ball in multiple areas; may retain original finish or original finish may appear discolored or faded; deep marks) |

The price data 106 is retrieved from retail specification sheets. The consumer price from leading U.S. golf retailers is averaged and summarized in U.S. dollars per dozen quantities.

Obtaining ball balance data 107 is performed on each golf ball by identifying the balance axis of the golf ball. A balanced golf ball is one that has equal weight distributed about an axis of a golf ball. An unbalanced golf ball is one that has portions of unequal weight distribution. If a golf ball is unbalanced, then the heavy portion of the golf ball will move to its equator when the ball is spun. Determination of the balance axis in a golf ball is accomplished by utilization of a golf ball spinner, a device known in the art, that spins the golf ball at 10,000 RPMs. Three consecutive measurements are made with each golf ball averaging them to determine if the golf ball is balanced or not. The data resulting from this test is a percentage of the total of balls tested for that model that are deemed balanced and indicates how reliably a ball may be considered balanced within the model. One dozen golf balls of each type, or a number that is deemed statistically significant, are subjected to this test. Scores may then be assigned to models according to a scheme similar to that used in the durability assessment. Table 2 is an exemplary balance scoring code.

TABLE 2

Exemplary Balance Scoring Code.

| Score | Percentage Balanced |
|---|---|
| 10 | ≧92% |
| 9 | 75-91% |
| 7 | 58-74% |
| 5 | 42-57% |
| 3 | 25-41% |

TABLE 2-continued

Exemplary Balance Scoring Code.

| Score | Percentage Balanced |
|---|---|
| 1 | 1-24% |
| 0 | 0% |

Referring to FIG. 2, the step of assigning a rating index 108 comprises the steps of calculating an average of the data obtained for each category of data 202, and associating a rating index to the ball based upon the average in each category 204. To compute the averages for the driver, iron, full and partial wedge tests, trimmed averages may be computed by eliminating the lowest and highest values and then computing the mean of the middle values. For example, if twelve shots are taken, the highest and lowest values are discarded and the middle ten values are used to compute the average. Trimmed averages mitigate the effects of extraneous values which can skew the mean. In addition to removal of highest and lowest values, any data that appears abnormal (outside of average tested) is eliminated. For the feel tests, the cover hardness and compression data are averaged over the number of golf balls per type subjected to the tests. An electronic spreadsheet program may be used to summarize averages based upon good data.

Associating a rating index consists of associating a set of pre-defined ratings for spin, distance, durability, balance and price per golf ball. Rating indexes are predefined to correspond to a value or range of values for each performance parameter. In one embodiment, the rating index is found by a calculation that provides an indication of a brand/model's performance as compared to other brand/models tested. For example, the averages for individual ball model performance and overall test group (i.e., all models tested) are calculated for each parameter. Then the difference between an individual model's performance average and the group average is found for each performance parameter. That difference may then be used as an argument to enter a table of pre-defined indexes. The same scheme may be used for spin performance as well. Table 2 is an exemplary scheme for defining distance and spin comparison rating indexes, referred to here as DNR and SNR respectively.

TABLE 2

Exemplary Rating Scheme for Distance and Spin Parameters

| Differential Spin (ΔSN) | SNR/DNR | Differential Distance (ΔDN) |
|---|---|---|
| ΔSN ≧ 1500 | 100 | ΔDN ≧ 15 |
| 1500 > ΔSN ≧ 1350 | 95 | 15 > ΔDN ≧ 13.5 |
| 1350 > ΔSN ≧ 1200 | 90 | 13.5 > ΔDN ≧ 12 |
| 1200 > ΔSN ≧ 1050 | 85 | 12.0 > ΔDN ≧ 10.5 |
| 1050 > ΔSN ≧ 900 | 80 | 10.5 > ΔDN ≧ 9.0 |
| 900 > ΔSN ≧ 750 | 75 | 9.0 > ΔDN ≧ 7.5 |
| 750 > ΔSN ≧ 600 | 70 | 7.5 > ΔDN ≧ 6.0 |
| 600 > ΔSN ≧ 450 | 65 | 6.0 > ΔDN ≧ 4.5 |
| 450 > ΔSN ≧ 300 | 60 | 4.5 > ΔDN ≧ 3.0 |
| 300 > ΔSN ≧ 150 | 55 | 3.0 > ΔDN ≧ 1.5 |
| 150 > ΔSN ≧ 0 | 50 | 1.5 > ΔDN ≧ 0 |
| −300 > ΔSN ≧ −150 | 45 | −3.0 > ΔDN ≧ −1.5 |
| −450 > ΔSN ≧ −300 | 40 | −4.5 > ΔDN ≧ −3.0 |
| −600 > ΔSN ≧ −450 | 35 | −6.0 > ΔDN ≧ −4.5 |
| −750 > ΔSN ≧ −600 | 30 | −7.5 > ΔDN ≧ −6.0 |
| −900 > ΔSN ≧ −750 | 25 | −9.0 > ΔDN ≧ −7.5 |
| −1050 > ΔSN ≧ −900 | 20 | −10.5 > ΔDN ≧ −9.0 |
| −1200 > ΔSN ≧ −1050 | 15 | −12.0 > ΔDN ≧ −10.5 |
| −1350 > ΔSN ≧ −1200 | 10 | −13.5 > ΔDN ≧ −12.0 |

TABLE 2-continued

| Exemplary Rating Scheme for Distance and Spin Parameters | | |
|---|---|---|
| Differential Spin (ΔSN) | SNR/DNR | Differential Distance (ΔDN) |
| −1500 > ΔSN ≧ −1350 | 05 | −15.0 > ΔDN ≧ −13.5 |
| ΔSN ≧ −1500 | 00 | ΔDN ≧ −15.0 |

Where

DN is a distance parameter, N = {Driver, Iron, Full Wedge, or Partial Wedge};

SN is a spin parameter, N = {Driver, Iron, Full Wedge, or Partial Wedge}; and

Δ is the difference between the individual model average value and the overall test group average value.

So, a ball model that demonstrates an average of 237 yards in distance with the driver, out of a test group that demonstrates an average of 230 yards in distance with a driver would have a ΔDD of +7 yards. Entering Table 2 above, the rating index, DDR, is 70.

Similarly, a scheme for associating rating indexes for performance values in feel and price may be used. Tables 3, and 4 are exemplary schemes for associating pre-defined rating indexes to average value ranges.

TABLE 3

| Exemplary Scheme for Associating Pre-Defined Rating Indexes to Feel Parameter Value Ranges. | | |
|---|---|---|
| | Description | |
| Rating | Compression Average | Cover Hardness Average |
| 10 | ≧119 | ≧91 |
| 9 | 108-113 | 88-90 |
| 8 | 102-107 | 84-89 |
| 7 | 96-101 | 81-83 |
| 6 | 90-95 | 78-80 |
| 5 | 84-89 | 75-77 |
| 4 | 78-83 | 72-74 |
| 3 | 72-77 | 69-71 |
| 2 | 66-71 | 66-68 |
| 1 | ≦65 | ≦65 |

TABLE 4

| Exemplary Scheme for Associating Pre-Defined Rating Indexes to Price Value Ranges. | |
|---|---|
| Rating | Consumer Price in U.S. Dollars |
| 10 | ≧42.00 |
| 9 | 38.00-41.99 |
| 8 | 34.00-37.99 |
| 7 | 30.00-33.99 |
| 6 | 26.00-29.99 |
| 5 | 22.00-25.99 |
| 4 | 18.00-21.99 |
| 3 | 14.00-17.99 |
| 2 | 10.00-13.99 |
| 1 | ≦9.99 |

It should be noted that model vs. group comparison indexes may be calculated and pre-defined for durability, feel, balance and price, as described with reference to the distance and spin performance criteria above. It should also be noted that for durability data and balance data, the scores for each model may be averaged, and also associated with a pre-defined rating index according to a scheme similar to those described above. The rating index for durability and balance also could be a rating index that indicates a comparison to the group of all models tested.

Indexes for each model may be then compiled and presented in any suitable format and in any suitable medium. Any of the performance parameters may be presented. One exemplary presentation format 300 is shown in FIG. 3 where rating indexes 302 for each performance parameter 304 for each model of golf ball 306 is compiled into a matrix 301.

As described above and shown in the associated drawings, the present invention comprises a method for rating golf balls. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. A method for providing a comparative rating of a golf ball model comprising the steps of:

a. for a plurality of golf ball models, obtaining test data for one or more golf ball performance parameters using at least one of a golf swing machine, a ball spinning machine, a compression testing machine, and a durometer, said performance parameters being at least one of: distance of flight employing a typical golf shot, spin of the golf ball during said typical golf shot, cover durability, feel, and balance and price;

b. using a computer, computing an individual average value of the data in each performance parameter for each model of said plurality and an overall average value in each performance parameter for all models tested;

c. assigning rating values to each said model for each said performance parameter based upon a difference between said individual average value and said overall average value, each of said rating values being assigned such that each said rating value indicates a performance characteristic of said model compared to all tested golf ball models without comparing said rating value to any other performance value associated with any other model.

2. The method of claim 1, wherein said golf shot is at least one of: a golf shot using a driver, a golf shot using an iron, a full wedge golf shot, and a partial wedge golf shot.

3. The method according to claim 2, wherein said feel parameter includes at least one of: cover hardness and compression.

4. The method according to claim 3, further comprising the step of presenting a compiled matrix of rating values according to golf ball model and performance parameter and wherein.

* * * * *